US006891913B1

(12) United States Patent
Andreyko

(10) Patent No.: US 6,891,913 B1
(45) Date of Patent: May 10, 2005

(54) NUCLEAR STORAGE OVERPACK DOOR ACTUATOR AND ALIGNMENT APPARATUS

(75) Inventor: Gregory M. Andreyko, North Huntingdon, PA (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 139 days.

(21) Appl. No.: 10/341,472

(22) Filed: Jan. 14, 2003

(51) Int. Cl.[7] ..... G21C 19/00; E05F 11/00; E06B 3/00

(52) U.S. Cl. ..... 376/272; 376/293; 250/506.1; 250/507.1; 49/324; 49/360; 49/362; 49/501

(58) Field of Search ..... 376/272, 293; 250/506.1, 507.1

(56) References Cited

U.S. PATENT DOCUMENTS 3,940,577 A * 2/1976 Christofer ..... 191/12 R
4,572,372 A * 2/1986 Smith et al. ..... 206/511
4,764,333 A * 8/1988 Minshall et al. ..... 376/203
5,295,167 A * 3/1994 Burner ..... 376/260
5,588,506 A * 12/1996 Born ..... 187/209
6,014,307 A * 1/2000 Crimmins ..... 361/170

FOREIGN PATENT DOCUMENTS

FR 2681637 A1 * 3/1993 ..... E05D/15/38
KR 2003009884 A * 2/2003 ..... B64C/25/32

* cited by examiner

*Primary Examiner*—Jack Keith
(74) *Attorney, Agent, or Firm*—Richard A. Morgan; Paul A. Gottlieb

(57) ABSTRACT

The invention is a door actuator and alignment apparatus for opening and closing the 15,000-pound horizontally sliding door of a storage overpack. The door actuator includes a ball screw mounted horizontally on a rigid frame including a pair of door panel support rails. An electrically powered ball nut moves along the ball screw. The ball nut rotating device is attached to a carriage. The carriage attachment to the sliding door is horizontally pivoting. Additional alignment features include precision cam followers attached to the rails and rail guides attached to the carriage.

18 Claims, 5 Drawing Sheets

NUCLEAR STORAGE OVERPACK DOOR ACTUATOR AND ALIGNMENT APPARATUS

STATEMENT OF GOVERNMENT INTEREST

The invention was conceived and made in the course of or under a contract with the U.S. Department of Energy.

BACKGROUND OF THE INVENTION

1. Field of the Invention

The invention relates to a ball screw actuator for moving a door panel. More particularly, the invention relates to a ball screw door panel actuator and guide. Most particularly the invention relates to a ball screw actuator and alignment assembly.

2. Discussion of the Related Art

Spent nuclear fuel is contained in a steel cylinder, referred to as a canister. Canisters are loaded into a concrete vessel, known as storage overpack or overpack for long term storage. The overpack is a bottom loaded storage container made of reinforced concrete and steel plates. The upper portion of the storage overpack is a 13-foot diameter cylindrical reinforced concrete vessel with a 74-inch diameter inner steel cylindrical liner. The vessel is supported on a stack of circular steel plates. The door is a horizontally oriented steel plate located below the mid-plane of the stack of plates. The stack of plates comprising the storage overpack door and doorframe provides the structural support for the loaded canister inside the storage overpack. It also provides shielding from radiation emitted from the canister. The interface between the sliding door and doorframe is steel-on-steel and requires an externally mounted actuator to effect opening and closing of the door through an approximately 100-inch travel distance.

The inventor was confronted with a number of challenges including the size and weight of the sliding door, and the limited space available for the actuator to operate. A hydraulic piston actuator was considered but could not be used because of space limitations. The piston stroke length would double the space required to open the door. Also, a portable door actuator was required that did not use local facilities such as stanchion posts or building walls for anchoring.

SUMMARY OF THE INVENTION

The invention is a ball screw actuator connectable to a horizontally disposed door panel. The ball screw actuator is used for moving the door panel horizontally. The ball screw actuator includes a rigid frame having parallel rails. A ball screw is attached to the rigid frame parallel to the rails. A ball nut rotating means is in drive contact with a ball nut movable along the ball screw. A carriage is moveable along the rails. The ball nut rotating device is fixedly attached to the carriage. Pivoting attachment means is provided for attaching the door panel to the carriage.

Other features and advantages of the invention will be set forth in, or apparent from, the following detailed description of the preferred embodiments of the invention.

DETAILED DESCRIPTION OF THE DRAWINGS

Figure 1:
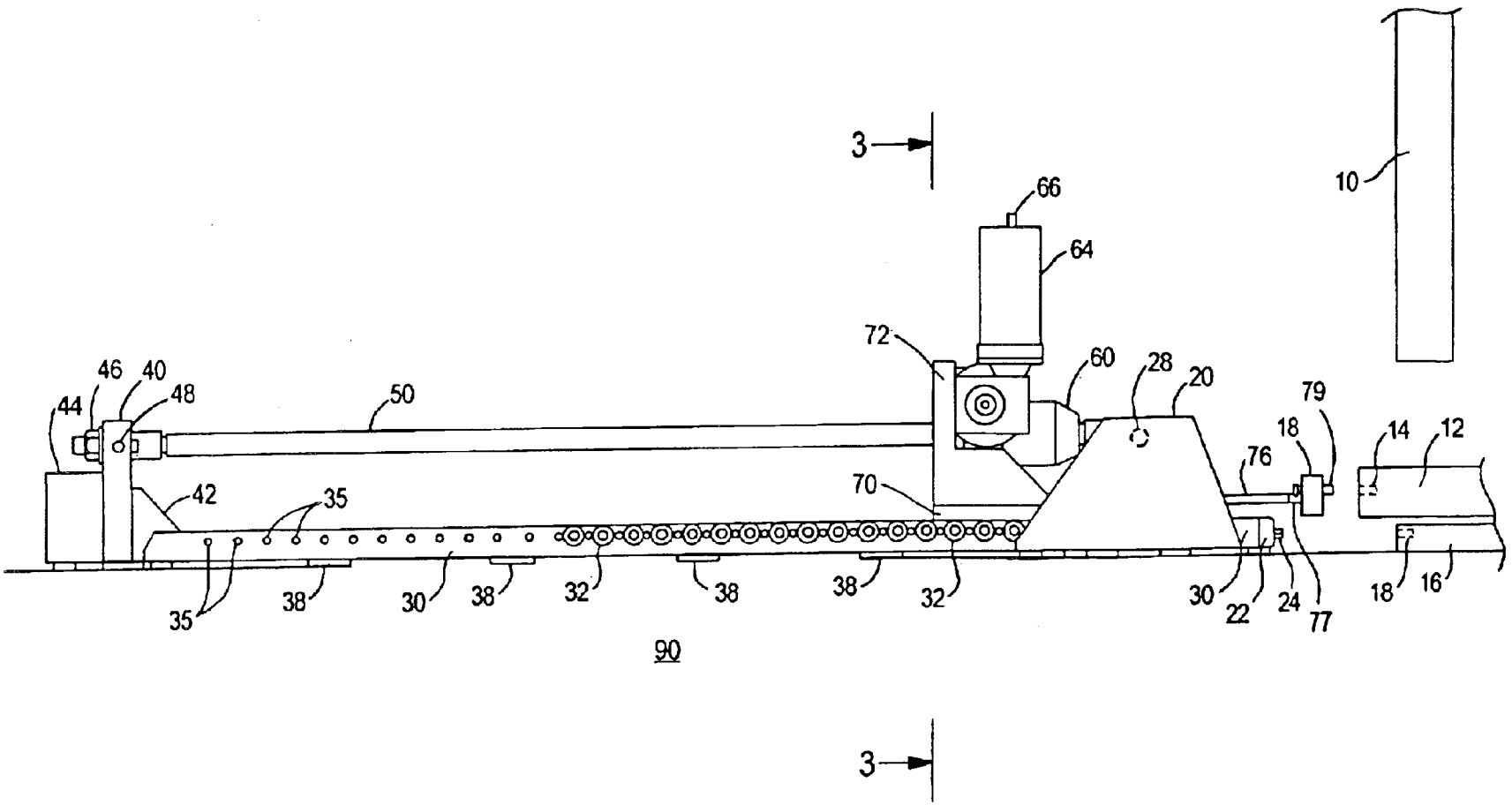
FIG. 1 is a side elevation view of the ball screw door panel alignment and actuator apparatus and a partial schematic view of a nuclear storage overpack.

Reference is made to FIG. 1 which shows an external wall 10 of a nuclear storage overpack. The nuclear storage overpack is a steel reinforce cylindrical vessel weighing in the order of 200 tons. The storage overpack is used for the long-term storage of spent nuclear fuel and other radioactive nuclear waste materials. A canister is loaded into the storage overpack from the bottom by way of horizontally oriented overpack door panel 12. A typical door panel 12 is a 10-foot long by 6.5-foot wide rectangular steel plate weighing in the order of 15,000 pounds. Radiation shield 15 is shown attached to the door panel in FIG. 2. Other ancillary attachments to door panel 12 not related to the invention are not shown. A door panel and ancillary attachments are referred to as a door panel assembly. An actuator for moving door panel 12 is attached to the door panel 12 via shoulder bolt 79 and threaded bore 14. Only a portion of doorframe 16 is shown. An actual doorframe 16 includes 4-inch thick steel plates above, below and on either side of the door panel 12. Threaded bore 18 is shown for anchoring an actuator front frame 20 to the 200-ton storage overpack by way of overpack doorframe 16.

Figure 2:
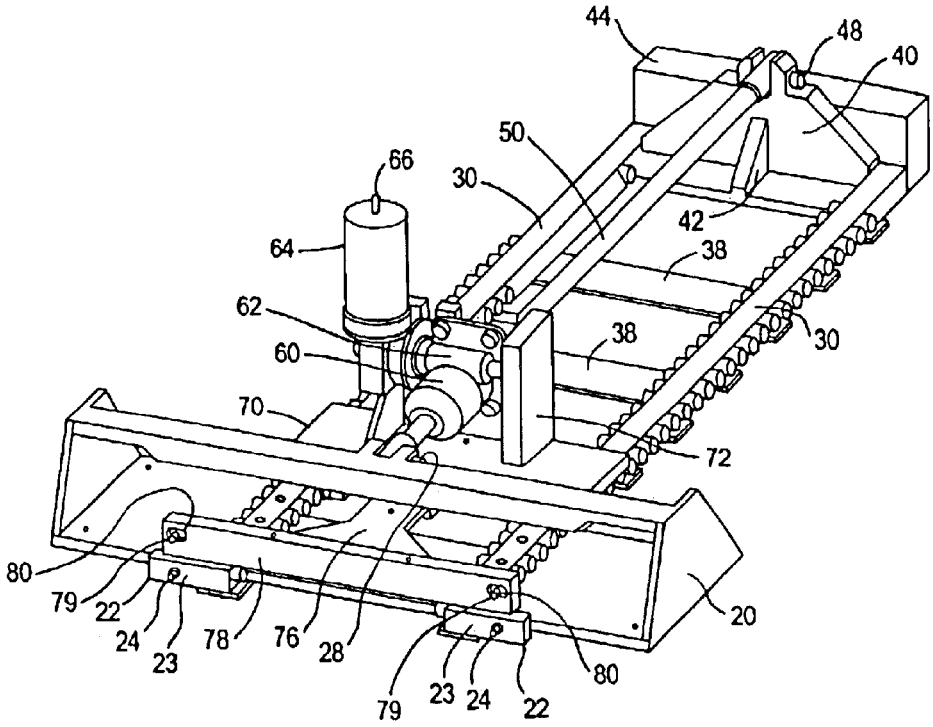
FIG. 2 is a perspective view of the ball screw door panel alignment and actuator apparatus of FIG. 1.

Reference is made to both FIG. 1 and FIG. 2. A rigid actuator frame is shown. The actuator frame includes a first end shown as front frame 20. A part of front frame 20 is frame foot 22 having frame foot face 23. Frame attachment bolt and washer 24 are positioned to mate with threaded bore 18 for attaching the front frame 20 to the doorframe 16. Rails 30 are attached to frame foot 22 at frame foot face 23. The parallel rails 30 are long enough to support the entire length of the door panel 12 in the open position, removed from overpack 10. In this example, the rails are about 14 feet long and are spaced 32 inches apart, braced by several rail spacer plates 38. Rails 30 extend to actuator frame second end including tail plate 40 braced by gusset 42. Front frame 20, spaced parallel rails 30, rail spacer plates 38, tail plate 40 and gusset 42 are assembled into a rigid actuator frame. The frame is anchored at the first end by attachment to the 200-ton storage overpack and at the second end by counter weight 44, weighing over 0.5 ton. The counter weight 44 provides additional weight to the tail plate 40 to prevent the frame from lifting off the cement floor 90 during operation. Anchoring the frame at both ends ensures that the rails remain flat on the surface of level concrete floor 90 during operation.

One end of an axially extending ball screw 50 is attached to front frame 20 by pin 28 and the other end is attached to tail plate 40 by pin 48. Nut 46 holds ball screw 50 in tension to assist in maintaining it straight and parallel to rails 30.

Ball nut 60 is mounted on threaded ball screw 50 and driven by ball nut rotating means 62. Ball nut rotating means 62 is a worm gear reducer powered by reversible drive electric motor 64 including electric motor control (not shown). The ball nut rotating means 62, and electric motor 64 are attached to carriage 70, with partial support of vertical support plate 72. The assembly of ball nut 60, ball nut rotating means 62, electric motor 64, carriage 70 and vertical support plate 72 are moveable along the length of ball screw 50 from actuator frame 20 to tail plate 40.

The alignment of carriage 70 along rails 30 is facilitated by a multiplicity of cam followers 32 mounted on the rails 30. The cam followers 32 cooperate with the actuator to guide the carriage 70 and maintain the straight alignment of the carriage with parallel rails 30 and parallel with ball screw 50.

Figure 3:
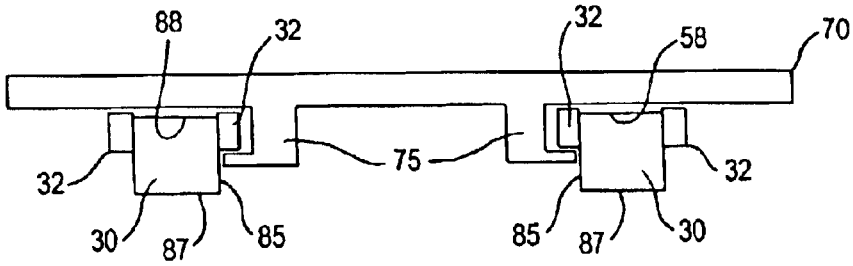
FIG. 3 is a partial view taken along line 3—3 of FIG. 1.

Rail guide bracket 75 is attached to the under side of carriage 70 as shown in FIG. 3. Rail guide bracket 75 prevents lateral movement of the carriage and further prevents deviation of carriage 70 in any lateral direction. Rail guide bracket 75 is spaced from rail inner surface 85 by an amount to allow only minimal deviation from true parallel in the travel of the carriage along the rails. The clearance between each rail guide bracket 75 and the rail inner surface 85 is 0.04-inch maximum, typically 0.01-inch. Rail guide bracket 75 permits movement of the carriage 70 parallel with rails 30 and thereby with ball screw 50 to avoid binding of the ball nut 60 on the ball screw 50.

Figure 4:
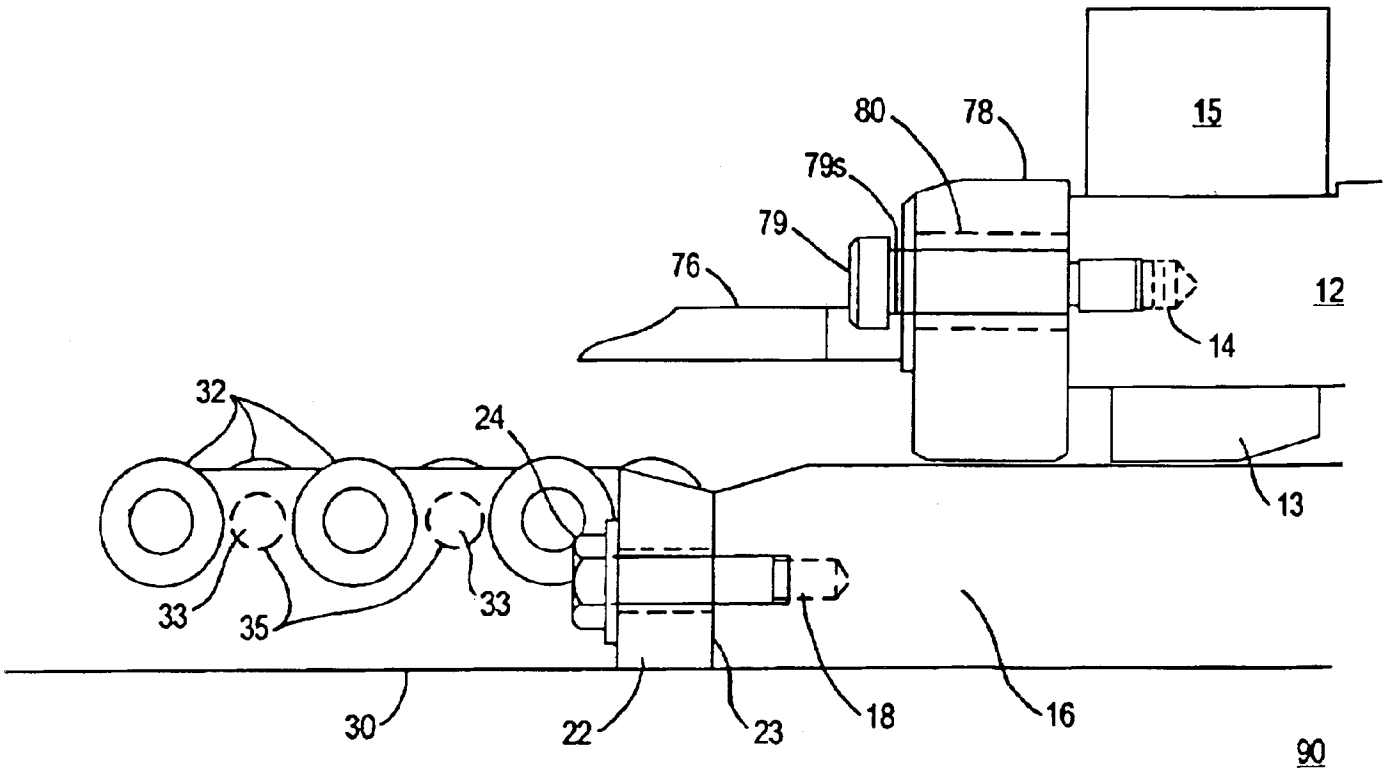
FIG. 4 is a partial elevation view of a an actuator apparatus attached to a door panel.

Attention is drawn to FIG. 4, showing the attachment of the actuator apparatus to door panel 12. Rail 30 is joined to doorframe 16 by way of frame foot 22. In FIG. 4, the door panel 12 is in the closed position, fully inserted in the doorframe 16. Support pad 13 and radiation shield 15 are two of a number of means for preventing radiation leakage from the overpack. The door panel 12 is supported by support pad 13. Support pad 13 is also the support contact between the door and the actuator. A plurality of cam followers 32 is attached to the rail 30. The plurality may number 50 to 100 cam followers per rail, e.g. 61 cam followers per rail. Cam follower 32 is a roller bearing with an integral threaded shaft. A cam follower 32 is attached to the rail by integral shaft 33. Integral shaft 33 is mounted in the horizontal plane with the axis of rotation perpendicular to rail 30. A roller bearing 36 is mounted to turn on integral shaft 33. Integral shaft 33 is the axis of rotation for roller bearing 36. A load on the circumferential surface 37 of the roller bearing is movable perpendicular to the axis of rotation, i.e. parallel to the rails.

Figure 5:
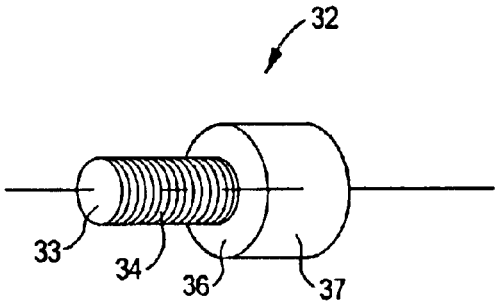
FIG. 5 is a plan view of a cam follower.

As seen in FIG. 5, one end of each integral shaft 33 has threads 34 so that it can be mounted in a tapped hole 35 (shown in FIG. 1) in rails 30. The threaded shaft 33 is mounted perpendicular to rail 30 in the tapped hole 35. The tolerance in alignment of the integral shaft from a true position is 0.010 inch, preferably 0.005 inch or less, with respect to three orthogonal datum surfaces of the actuator frame. Three datum surfaces used are the rail bottom surface 87, the frame foot face 23 that interfaces with the overpack and the inner surfaces 85 of the rails that interface with the carriage via rail guide bracket 75. The three datum surfaces were selected because they are related to the function of the actuator frame relative to the overpack and because they facilitated alignment during fabrication. The tapped holes are staggered on either side of the rail. Also, the bearing circumferential surface 37 holds the support pad 13 above the rail. Therefore support pad 13 comes in contact with cam followers and does not come into contact with the rail head surface 88 as it moves along the rail.

Link plate 76 and door panel attachment plate 78 are attached to carriage 70. Door panel attachment plate 78 includes slots 80 through which pass threaded door panel shoulder bolts 79. Shoulder bolt 79 and washer 79*s* mate with door threaded bore 14 in door panel 12. Shoulder bolt 79 and washer 79*s* are used to attach the door panel 12 to carriage 70. Washer 79*s* is designed to ensure that a slight clearance exists between attachment plate 78 and the head of the shoulder bolt 79. Some lateral repositioning between the actuator and door panel is accommodated by slot 80 in attachment plate 78. The gap provided by shoulder bolt washer 79*s* together with lateral space provided in slot 80 ensures any bending moment on the shoulder bolt 79 is quickly resolved and any lateral load, which would risk failure of the shoulder bolt 79 during operation, does not persist.

Carriage 70 is drawn along ball screw 50 supported on rails 30. Door panel 12 is drawn along with the carriage 70. The alignment of the carriage with rails 30 and ball screw 50 maintains the lateral alignment of the door panel 12 relative to doorframe 16. The resulting opening and closing the door panel 12 is effected without ancillary equipment to realign or reposition the door panel.

The function of the actuator frame is to counter lateral forces developed during open and closing. Lateral forces are those forces that are not parallel to the center of rotation of ball nut 60, i.e. the longitudinal axis of ball screw 50. The frame includes a pair of rails that support the door panel while open and during opening and closing. The ball screw is positioned with high precision parallel to the pair of rails. The parallel orientation of ball screw with the rails prevents any tendency toward lateral movement of the door panel. The first end or front end of the frame includes a front bracket that is attachable to a doorframe that is part of the 200-ton storage overpack vessel. The second or terminal end referred to as the tailstock of the frame is attached to a removable counter weight. This counter weight resists lifting force or bending force during rotating of the threaded screw and tension on the door panel during opening. The actuator frame is constructed of ASTM A516 (Fineline™) carbon steel.

ASTM A516 Fineline™ carbon steel is resistant to base metal lamellar tearing. Base metal lamellar tearing can occur in rolled carbon steel plate having a relatively high sulfur content when sulfur deposits along the base metal rolling planes and precipitates out during the rolling process. Lamellar tearing occurs in the through thickness direction resulting in a terrace-like fracture in the base metal parallel to the wrought surface. The actuator frame, carriage and attachment are ASTM A516 Grade 70 carbon steel made according to the Bethlehem-Lukens Fineline™ process. This process was developed to produce low-sulfur content steel in order to eliminate base metal lamellar tearing.

The ball nut rotating means, referred to as the actuator, is mounted on the carriage. The carriage is the member through which the drive forces are transmitted from the electric motor and drive nut rotating means to the door panel. The carriage incorporates two L-shaped rail guide brackets attached at the under side to react the torque and bending moment developed during operation and to prevent the carriage from deviating much from its linear path along the rails.

Figure 6:
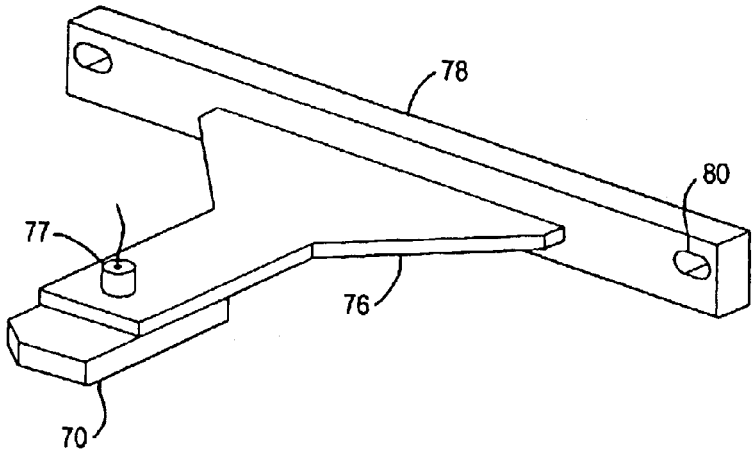
FIG. 6 is a perspective view illustrating the details of a link plate.

Attention is drawn to FIG. 6. The carriage 70 is connected to the door panel attachment plate 78 by link plate 76. Link plate 76 provides for transmitting the pushing and pulling forces from the door actuator assembly including electric motor 64 to the sliding door panel 12. Link plate 76 is attached to door panel attachment plate 78 with pivoting attachment means 77. Pivoting attachment means 77 is preferably a shear pin to allow pivoting needed to accommodate positional misalignments of the sliding door panel relative to the carriage and the doorframe front support plate 16 of storage overpack 10. The pin is oriented perpendicular to the rails 30 and fixes link plate 76 and attachment plate 78 in a generally horizontal plane. This orientation allows pivoting of the door panel attachment plate to accommodate small misalignments between the door panel and carriage and between the door panel and doorframe.

An instrumented shear pin, shown in FIG. 6 as pivoting attachment means 77, attaches the actuator to the carriage. The instrumented shear pin is sized for the 16,500 pound load with a 2.2 safety factor. A scale meter measures and indicates load during operation. A control circuit monitors the scale meter to shut off the motor should a preselected load be exceeded. The shear pin and scale meter shut-off circuit are an integral interlock and a redundant safety feature to provide overload protection.

The door panel attachment plate 78 is attached to the door panel 12 by two 1-8UNC (1 inch diameter, 8 threads per inch, Unified Thread Series Coarse) tapped bores, shown as bore 14, and shoulder bolts, shown as bolt 79, to allow for motion during door panel movement.

Two 3.75-inch alloy steel frame attachment bolts, shown as bolt and washer 24, attach the frame foot 22 to the doorframe front support plate 16. The frame attachment bolts secure the door assembly to the frame foot 22.

The actuator was a Duff-Norton, 25-ton screw actuator and ball screw. A 5-horsepower electric motor and motor control were coupled to the ball screw actuator to operate the actuator. A motor shaft extension 66 provides for manual operation of the actuator in the event of electric power failure.

The actuator size was determined by the length/column strength of the ball screw required to accommodate the 100-inch travel length. The screw diameter corresponding with a 100+ inch screw was 3 inches. This defined the minimum actuator size for this service, i.e. 25-ton. The maximum capacity of the actuator when coupled with the 5 horsepower motor is 44,000 pounds. However, the actuator frame would have to be blocked and secured to prevent the frame from deflection in order to accommodate this load. In a typical configuration, the frame is designed for a load of 16,500 pounds. The life expectancy of the ball screw and drive nut is 28,000 cycles, assuming no misalignment or side thrust loads and reasonable maintenance and lubrication. The time required to open or to close the door with a 5 horsepower (1750 rpm) motor and the actuator/reducer assembly disclosed is 21.7 inches/minute or about 5 minutes.

A limit switch (not shown) was included to stop actuator travel. The limit switch operates by way of the actuator worm gear rotation that turns an integral screw. Two micro switches are provided, one for forward stopping the other for backward stopping, are activated by the position of two adjustable limit switch nuts which travel laterally when the internal screw is rotated.

Threaded ball screw length determined the actuator size and strength of the screw required effecting the 100-inch travel with the design load. The maximum unsupported or unguided length for the ball screw required is about 60 inches. To accommodate the 100-inch travel distance, the ball screw had to be supported or guided to prevent buckling. This was accomplished by mounting the drive nut on the carriage. The carriage assembly is guided between the fixed frame rails. Lateral movement, i.e. side thrust loading, is controlled by limiting the clearance between the L-brackets on the underside of the carriage assembly and the inside of the frame rails. Side thrust loading, eccentric loading, and screw buckling are reduced or entirely prevented by mounting the actuator on the carriage assembly.

Inventor was challenged to find a reliable way of ensuring the ball nut center axis was positioned concentric with the screw axis over the entire travel distance while under load. Any misalignments greater than the basic pitch-type clearances between the ball nut and screw are significant in this unique application, moving the horizontally sliding door of a nuclear storage overpack. Significant misalignments would bind the screw. Less significant misalignments would shorten the life of a ball screw assembly due to increased screw and ball nut wear. Other forces affecting ball nut to ball screw alignment are the reaction forces associated with opening and closing the door.

The invention provides three performance requirements. First, the load on the ball screw must be kept as parallel to the ball screw axis as possible. Second, door panel load must be applied along the same axis as the ball screw. Third, side thrust loads and moments on the ball nut and screw should be minimized and preferably avoided. Due to space limitations, the door panel load could not be applied along the same axis as the screw. Also, to accommodate the door as it moves out from under the overpack, the screw had to be mounted about 8 inches above the centerplane of the door and about 11 inches above the carriage to frame reaction plane. An under door mount was considered but found to be impossible due to the limited space available to accommodate the screw and actuator housing below the door panel. This offset between the screw centerline and the door panel centerplane applies a reaction moment that misaligns the drive nut relative to the screw. This misaligning reaction moment was countered by the carriage assembly to ensure the actuator would operate at design load.

The inventive alignment and actuator system provides or opening and closing the 15,000 pound sliding door of a storage overpack. The door actuator includes an electrically powered ball screw actuator mounted horizontally in a portable frame. The actuator assembly does not require any external mounting facilities such as a stanchion post to anchor the assembly in order to counter loads developed during operation. The integral actuator frame accommodates operational loads. A door actuator test unit has been successfully tested with over 170 opening and closing cycles on a prototype door and frame assembly.

Table of Elements in the Drawing

| | |
|---|---|
| 10 | storage overpack wall |
| 12 | overpack door panel |
| 13 | support pad |
| 14 | door threaded bore |
| 16 | doorframe |
| 18 | doorframe threaded bore |
| 20 | actuator front frame |
| 22 | frame foot |
| 23 | frame foot face |
| 24 | frame attachment bolt and washer |
| 28 | front pin |
| 30 | rails |
| 32 | cam followers |
| 33 | integral shaft |
| 34 | threads |
| 35 | tapped hole |
| 36 | roller bearing |
| 37 | bearing circumferential surface |
| 38 | rail spacer plate |
| 40 | tail plate |
| 42 | gusset |
| 44 | counter weight |
| 46 | nut |
| 48 | end pin |
| 50 | ball screw |
| 60 | ball nut |
| 62 | ball nut rotating means |
| 64 | reversible drive electric motor |
| 66 | motor shaft extension |

-continued

| Table of Elements in the Drawing | |
|---|---|
| 70 | carriage |
| 72 | vertical support plate |
| 75 | rail guide bracket |
| 76 | link plate |
| 77 | pivoting attachment means |
| 78 | door panel attachment plate |
| 79 | shoulder bolt |
| 79s | washer |
| 80 | slot |
| 85 | rail inner surfaces |
| 87 | rail bottom surfaces |
| 90 | cement floor |

The foregoing discussion discloses and describes embodiments of the present invention by way of example. One skilled in the art will readily recognize from this discussion and from the accompanying drawings and claims, that various changes, modifications and variations can be made therein without departing from the spirit and scope of the invention as defined in the following claims.

What is claimed is:

1. A ball screw door panel actuator including:

a rigid frame having parallel, horizontally disposed rails, a ball screw attached to the rigid frame parallel to the rails, a ball nut rotating means including a ball nut movable along the ball screw, the ball nut rotating means attached to a carriage, the carriage, moveable along the rails, and pivoting attachment means for attaching a door panel to the carriage.

2. The ball screw door panel actuator of claim 1 including rail guide brackets attached to the carriage for limiting lateral motion of the carriage relative to the rails.

3. The ball screw door panel actuator of claim 1 including rollers providing support of the door panel above the rails, the rollers aligned to allow motion of the door panel parallel to the rails.

4. The ball screw door panel actuator of claim 1 including cam followers attached to the rails providing support of the door panel above the rails, the cam followers aligned to allow motion of the door panel parallel to the rails.

5. The ball screw door panel actuator of claim 1 including means for anchoring the rigid frame.

6. The ball screw door panel actuator of claim 1 including means for attaching the rigid frame to a doorframe.

7. A ball screw door panel actuator including:

a rigid frame having a first end, a second end and parallel, horizontally disposed rails connecting the two ends, a ball screw attached to the rigid frame first end and second end, parallel to the rails, a ball nut rotating means including a ball nut movable along the ball screw, the ball nut rotating means attached to a carriage, the carriage moveable along the rails, and horizontally pivoting attachment means for attaching the door panel to the carriage.

8. The ball screw door panel actuator of claim 7 including a pair of rail guide brackets attached to the carriage for limiting lateral motion of the carriage relative to the rails.

9. The ball screw door panel actuator of claim 7 including rollers providing support of the door panel above the rails, the rollers aligned to allow motion of the door panel parallel to the rails.

10. The ball screw door panel actuator of claim 7 including cam followers attached to the rails providing support of the carriage above the rails, the cam followers aligned to allow motion of the carriage parallel to the rails.

11. The ball screw door panel actuator of claim 7 including means for anchoring the rigid frame.

12. The ball screw door panel actuator of claim 7 including means for anchoring the rigid frame to a doorframe.

13. A ball screw door panel actuator in combination with a nuclear storage overpack, including:

a rigid frame having pair of parallel, horizontally disposed rails, a multiplicity of cam followers having shafts and roller bearings, the shafts attached perpendicular to the rails, the roller bearings positioned to support the door panel above the rails, a ball screw attached to the rigid frame parallel to the rails, a ball nut rotating means including a ball nut, movable along the ball screw, the ball nut rotating means attached to a carriage, the carriage movable along the rails, the carriage having rail guides for limiting lateral motion, and means for attaching a nuclear storage overpack door panel to the carriage.

14. The ball screw door panel actuator of claim 13 wherein the means for attaching the door panel to the carriage allows pivoting.

15. The ball screw door panel actuator of claim 13 wherein the means for attaching the door panel to the carriage allows horizontal pivoting.

16. The ball screw door panel actuator of claim 13 including means for attaching the rails to the nuclear storage overpack.

17. The ball screw door panel actuator of claim 13 additionally including load sensing means.

18. The ball screw door panel actuator of claim 13 additionally including a load sensor and ball nut rotating means shutoff means.

* * * * *